US010174946B2

(12) United States Patent
Cunha et al.

(10) Patent No.: US 10,174,946 B2
(45) Date of Patent: Jan. 8, 2019

(54) NOZZLE GUIDE FOR A COMBUSTOR OF A GAS TURBINE ENGINE

(71) Applicant: United Technologies Corporation, Farmington, CT (US)

(72) Inventors: Frank J. Cunha, Avon, CT (US); Stanislav Kostka, Shrewsbury, MA (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 478 days.

(21) Appl. No.: 14/950,876

(22) Filed: Nov. 24, 2015

(65) Prior Publication Data

US 2016/0146465 A1 May 26, 2016

Related U.S. Application Data

(60) Provisional application No. 62/084,100, filed on Nov. 25, 2014.

(51) Int. Cl.

| | |
|---|---|
| ***F02C 1/00*** | (2006.01) |
| ***F23R 3/00*** | (2006.01) |
| ***F23R 3/28*** | (2006.01) |

(52) U.S. Cl.

CPC ..... *F23R 3/002* (2013.01); *F23R 3/283* (2013.01); *F23R 2900/03043* (2013.01); *F23R 2900/03044* (2013.01)

(58) Field of Classification Search

CPC ..... F23R 2900/03041; F23R 3/002; F23R 2900/03042; F23R 2900/03043

See application file for complete search history.

(56) References Cited

U.S. PATENT DOCUMENTS

| | | | | |
|---|---|---|---|---|
| 4,766,722 | A | 8/1988 | Bayle-Laboure et al. | |
| 4,914,918 | A | 4/1990 | Sullivan | |
| 5,419,115 | A * | 5/1995 | Butler | F23R 3/10 60/740 |
| 5,941,076 | A * | 8/1999 | Sandelis | F23R 3/002 60/752 |
| 2005/0011196 | A1* | 1/2005 | Leen | F01D 11/18 60/772 |
| 2007/0193273 | A1* | 8/2007 | DeVane | F23R 3/002 60/752 |
| 2011/0154825 | A1* | 6/2011 | Roesler | F23R 3/14 60/748 |
| 2013/0174562 | A1* | 7/2013 | Holcomb | F23R 3/002 60/752 |
| 2014/0311153 | A1* | 10/2014 | Smallwood | F23R 3/002 60/772 |

OTHER PUBLICATIONS

European Search Report for Application No. 15196098.6-1602; dated Apr. 1, 2016; 7 pgs.

* cited by examiner

*Primary Examiner* — Gerald L Sung
(74) *Attorney, Agent, or Firm* — Cantor Colburn LLP

(57) ABSTRACT

A nozzle guide is provided for a combustor of a gas turbine engine. The nozzle guide includes an annular structure including a plurality of cooling holes, a guide plate including a plurality of openings on an outer periphery of the guide plate, and a plurality of cooling passages within the annular structure to provide air flow from the plurality of cooling holes to the plurality of openings.

20 Claims, 4 Drawing Sheets

NOZZLE GUIDE FOR A COMBUSTOR OF A GAS TURBINE ENGINE

CROSS REFERENCE TO RELATED APPLICATIONS

This application claims the benefit of U.S. Provisional Application Ser. No. 62/084,100 filed Nov. 25, 2014, the entire contents of which are incorporated herein by reference thereto.

FIELD

The present disclosure relates to gas turbine engines and, in particular, to nozzle guides and combustor components of a gas turbine engine.

BACKGROUND

Gas turbine engines are required to operate efficiently during operation and flight. Theses engines create a tremendous amount of force and generate high levels of heat. As such, components of these engines are subjected to high levels of stress, temperature and pressure. It is necessary to provide components that can withstand the demands of a gas turbine engine. It is also desirable to provide components with increased operating longevity.

BRIEF SUMMARY OF THE DISCLOSURE

Disclosed and claimed herein is a nozzle guide for a combustor of a gas turbine engine. In one embodiment, the nozzle guide includes an annular structure having an inner surface and outer surface, the inner surface including a plurality of cooling holes, and wherein the cooling holes of the annular structure are configured to receive air flow. The nozzle guide also includes a guide plate configured to engage with a combustor shell, the guide plate including a plurality of openings located proximate to an outer periphery of the guide plate, and wherein the plurality of openings provide air flow to the outer periphery of the guide plate. The nozzle guide includes a plurality of cooling passages within the inner and outer surface of the annular structure and within the guide plate, the plurality of cooling passages configured to provide air flow from the plurality of cooling holes to the plurality of openings of the guide plate.

In one embodiment, the annular structure is configured to receive a fuel nozzle.

In one embodiment, the guide plate engages with a combustor shell to contact a combustor shell bulkhead.

In one embodiment, a distal end of the guide plate is angled towards a combustor shell bulkhead.

In one embodiment, a thickness of the guide plate is increased for mounting the nozzle guide to a combustor shell.

In one embodiment, the openings are holes along the mounting surface of the guide plate in close proximity to the outer periphery of the guide plate.

In one embodiment, the openings are wavelike deformations in a surface of the guide plate.

In one embodiment, the openings provide radial air flow to cool the guide plate surface.

In one embodiment, the nozzle guide is a diffuser for a combustor shell.

Another embodiment is directed to a combustor of a gas turbine engine including a combustor shell, wherein the shell is configured to receive a nozzle guide, and a nozzle guide. The nozzle guide includes an annular structure having an inner surface and outer surface, the inner surface including a plurality of cooling holes, wherein the cooling holes of the annular structure are configured to receive air flow, a guide plate configured to engage with a combustor shell, the guide plate including a plurality of openings located proximate to an outer periphery of the guide plate, wherein the plurality of openings provide air flow to the outer periphery of the guide plate, and a plurality of cooling passages within the inner and outer surface of the annular structure and within the guide plate to provide air flow from the plurality of cooling holes to the plurality of openings of the guide plate.

In one embodiment, the annular structure is configured to receive a fuel nozzle.

In one embodiment, the guide plate engages with a combustor shell to contact a combustor shell bulkhead.

In one embodiment, a distal end of the guide plate is angled towards a combustor shell bulkhead.

In one embodiment, a thickness of the distal end of the guide plate flange is increased for mounting the nozzle guide to the combustor shell.

In one embodiment, the openings are holes along the mounting surface of the guide plate in close proximity to the outer periphery of the guide plate.

In one embodiment, the openings are wavelike deformations in a surface of the guide plate.

In one embodiment, the openings provide radial air flow to cool the guide plate surface.

In one embodiment, the nozzle guide is a diffuser for a combustor shell.

Another embodiment is directed to a nozzle guide for a combustor of a gas turbine engine, the nozzle guide including an annular structure having an inner surface and outer surface, the inner surface including a plurality of cooling holes, wherein the cooling holes of the annular structure are configured to receive air flow, and a guide plate extending from a base of the annular structure, the guide plate including a plurality of openings located proximate to an outer periphery of the guide plate, wherein the plurality of openings provide air flow to the outer periphery of the guide plate, and wherein the outer periphery extends away from the base of the annular structure. The nozzle guide includes a plurality of cooling passages within the inner and outer surface of the annular structure and within the guide plate to provide air flow from the plurality of cooling holes to the plurality of openings of the guide plate.

In one embodiment, the outer periphery of the guide plate is curved to extend into a combustor shell away from the annular structure.

In one embodiment, a nozzle guide for a combustor of a gas turbine engine is provided. The nozzle guide having: an annular structure having an inner surface and outer surface, the inner surface including a plurality of cooling holes, wherein the cooling holes of the annular structure are configured to receive air flow; a guide plate configured to engage with a combustor shell, the guide plate including a plurality of openings located proximate to an outer periphery of the guide plate, wherein the plurality of openings provide air flow to the outer periphery of the guide plate; and a plurality of cooling passages within the inner and outer surface of the annular structure and within the guide plate, the plurality of cooling passages configured to provide air flow from the plurality of cooling holes to the plurality of openings of the guide plate.

In addition to one or more of the features described above, or as an alternative to any of the foregoing embodiments, the annular structure may be configured to receive a fuel nozzle.

In addition to one or more of the features described above, or as an alternative to any of the foregoing embodiments, the guide plate engages with a combustor shell to contact a combustor shell bulkhead.

In addition to one or more of the features described above, or as an alternative to any of the foregoing embodiments, a distal end of the guide plate is angled towards a combustor shell bulkhead.

In addition to one or more of the features described above, or as an alternative to any of the foregoing embodiments, a thickness of the guide plate is increased for mounting the nozzle guide to a combustor shell.

In addition to one or more of the features described above, or as an alternative to any of the foregoing embodiments, the openings are holes along the mounting surface of the guide plate in close proximity to the outer periphery of the guide plate.

In addition to one or more of the features described above, or as an alternative to any of the foregoing embodiments, the openings are wavelike deformations in a surface of the guide plate.

In addition to one or more of the features described above, or as an alternative to any of the foregoing embodiments, the openings provide radial air flow to cool the guide plate surface.

In addition to one or more of the features described above, or as an alternative to any of the foregoing embodiments, the nozzle guide is a diffuser for a combustor shell.

In yet another embodiment, a combustor of a gas turbine engine is provided. The combustor having: a combustor shell, wherein the shell is configured to receive a nozzle guide; and a nozzle guide including: an annular structure having an inner surface and outer surface, the inner surface including a plurality of cooling holes, wherein the cooling holes of the annular structure are configured to receive air flow; a guide plate configured to engage with a combustor shell, the guide plate including a plurality of openings located proximate to an outer periphery of the guide plate, wherein the plurality of openings provide air flow to the outer periphery of the guide plate; and a plurality of cooling passages within the inner and outer surface of the annular structure and within the guide plate to provide air flow from the plurality of cooling holes to the plurality of openings of the guide plate.

In addition to one or more of the features described above, or as an alternative to any of the foregoing embodiments, the annular structure is configured to receive a fuel nozzle.

In addition to one or more of the features described above, or as an alternative to any of the foregoing embodiments, the guide plate engages with a combustor shell to contact a combustor shell bulkhead.

In addition to one or more of the features described above, or as an alternative to any of the foregoing embodiments, a distal end of the guide plate is angled towards a combustor shell bulkhead.

In addition to one or more of the features described above, or as an alternative to any of the foregoing embodiments, a thickness of the distal end of the guide plate flange is increased for mounting the nozzle guide to the combustor shell.

In addition to one or more of the features described above, or as an alternative to any of the foregoing embodiments, the openings are holes along the mounting surface of the guide plate in close proximity to the outer periphery of the guide plate.

In addition to one or more of the features described above, or as an alternative to any of the foregoing embodiments, the openings are wavelike deformations in a surface of the guide plate.

In addition to one or more of the features described above, or as an alternative to any of the foregoing embodiments, the openings provide radial air flow to cool the guide plate surface.

In addition to one or more of the features described above, or as an alternative to any of the foregoing embodiments, the nozzle guide is a diffuser for a combustor shell.

In yet another embodiment, a nozzle guide for a combustor of a gas turbine engine is provided. The nozzle guide having: an annular structure having an inner surface and outer surface, the inner surface including a plurality of cooling holes, wherein the cooling holes of the annular structure are configured to receive air flow; a guide plate extending from a base of the annular structure, the guide plate including a plurality of openings located proximate to an outer periphery of the guide plate, wherein the plurality of openings provide air flow to the outer periphery of the guide plate, and wherein the outer periphery extends away from the base of the annular structure; and a plurality of cooling passages within the inner and outer surface of the annular structure and within the guide plate to provide air flow from the plurality of cooling holes to the plurality of openings of the guide plate.

In addition to one or more of the features described above, or as an alternative to any of the foregoing embodiments, the outer periphery of the guide plate is curved to extend into a combustor shell away from the annular structure.

Other aspects, features, and techniques will be apparent to one skilled in the relevant art in view of the following detailed description of the embodiments.

BRIEF DESCRIPTION OF THE DRAWINGS

The features, objects, and advantages of the present disclosure will become more apparent from the detailed description set forth below when taken in conjunction with the drawings in which like reference characters identify correspondingly throughout and wherein.

DETAILED DESCRIPTION OF THE DISCLOSURE

Overview and Terminology

One aspect of this disclosure relates to components of a gas turbine engine and, in particular, a nozzle guide. In one embodiment, a nozzle guide is provided including an annular structure, guide plate and one or more passages to provide air flow around the guide plate. The nozzle guide may be employed for use with a combustor of a gas turbine engine where air and combustible material are ignited. Combustion of these materials provides thrust for a gas turbine engine. The nozzle guide may be mounted to combustor shell and provides a support structure for the fuel nozzle to be engaged and supply fuel to the combustion chamber. The nozzle guide can also allow air flow from the exterior of the combustor to the interior of the combustion chamber. The nozzle guide includes one or more features to allow for air traveling into the nozzle guide to cool the structure and to decrease the distress to nozzle guide during gas turbine engine operation.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics may be combined in any suitable manner on one or more embodiments without limitation.

Exemplary Embodiments

Figure 1:
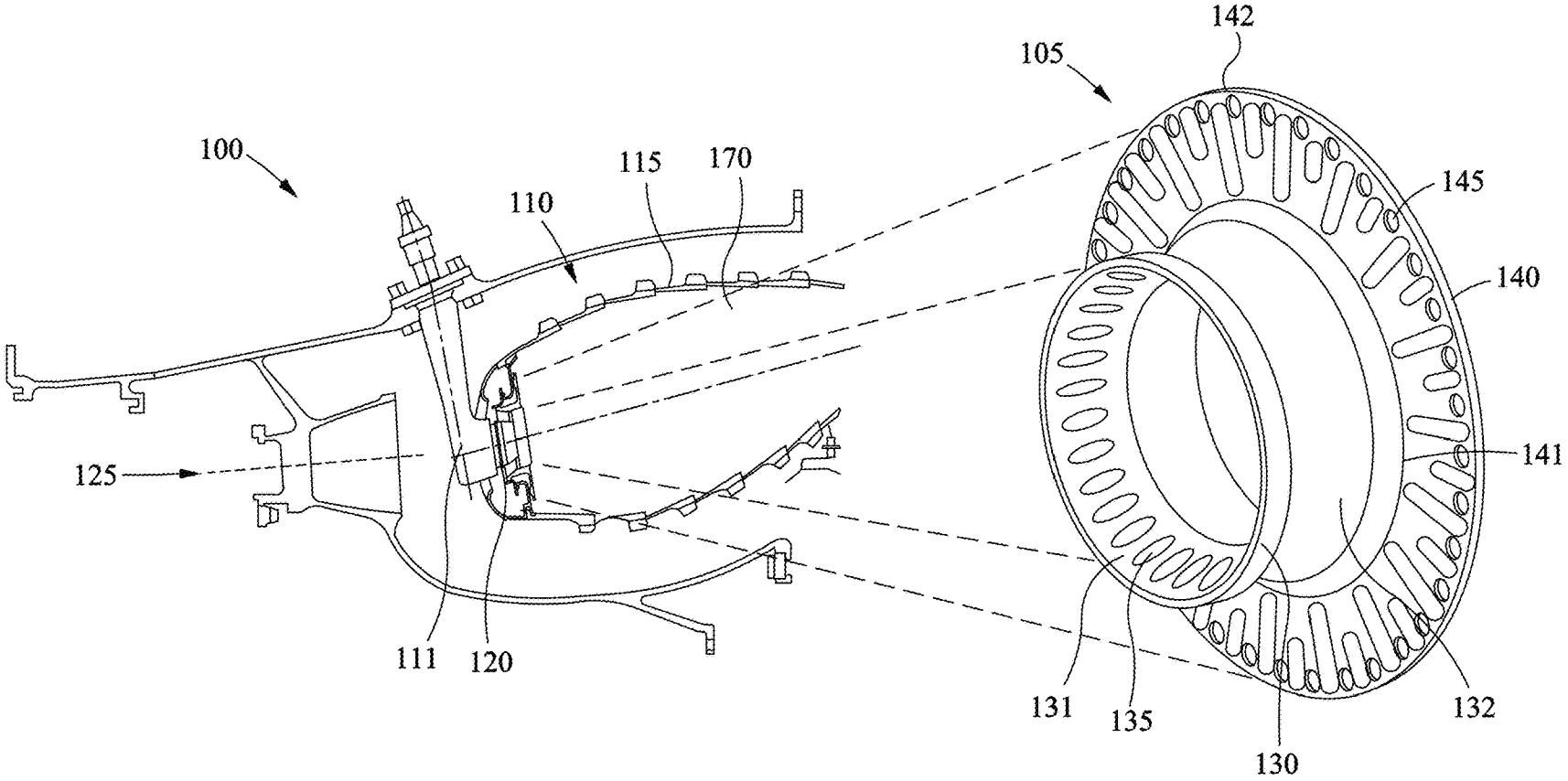
FIG. 1 depicts a graphical representation of a combustor including a nozzle guide according to one or more embodiments.

Referring now to the figures, FIG. 1 depicts a graphical representation of a combustor of a gas turbine engine 100 including a nozzle guide 105 according to one or more embodiments. According to one embodiment, a gas turbine engine 100 includes combustor 110. Gas turbine engine 100 is configured to channel air flow 125 towards combustor 110 and through the combustion chamber 170 for mixing air flow 125 with fuel output by fuel injector 111. Nozzle guide 105 may be a diffuser for a gas turbine engine.

According to one embodiment, combustor 110 includes a plurality of combustor shells, such as combustor shell 115, around a circumference of the combustor. Combustor 110 includes shell 115 having a combustion chamber 170. Shell 115 is configured to engage with fuel injector 111. According to one embodiment, shell 115 is configured to engage with nozzle guide 105 at one end of the shell 115. Shell 115 may be configured to engage with a fuel nozzle 120 of fuel injector 111. Nozzle guide 105 can be configured to mix air flow 125 and fuel from fuel injector 111 as air and fuel enter shell 115. Combustor 110 including shell 115 is configured to have an exhaust end of the structure for air flow or other combustible material to exit combustion chamber 170.

Nozzle guide 105 includes annular structure 130, guide plate 140. Nozzle guide 105 is configured to be mounted to a bulkhead (shown as 250 in FIG. 2) of shell 115. Nozzle guide 105 is also configured to channel air flow 125 from outside combustor 110 to within combustion chamber 170. Nozzle guide 105 may be configured to control air flow 125 into combustor chamber 170. Moreover, nozzle guide 105 can also direct air flow 125 and/or control the amount of swirl for combustor shell 115 based at least in part on one or more of cooling holes 135 and passages within the nozzle guide 105. As will be described in more detail below, nozzle guide 205 may include one or more passages between cooling holes 130 and opening of guide plate 140.

Figure 4:
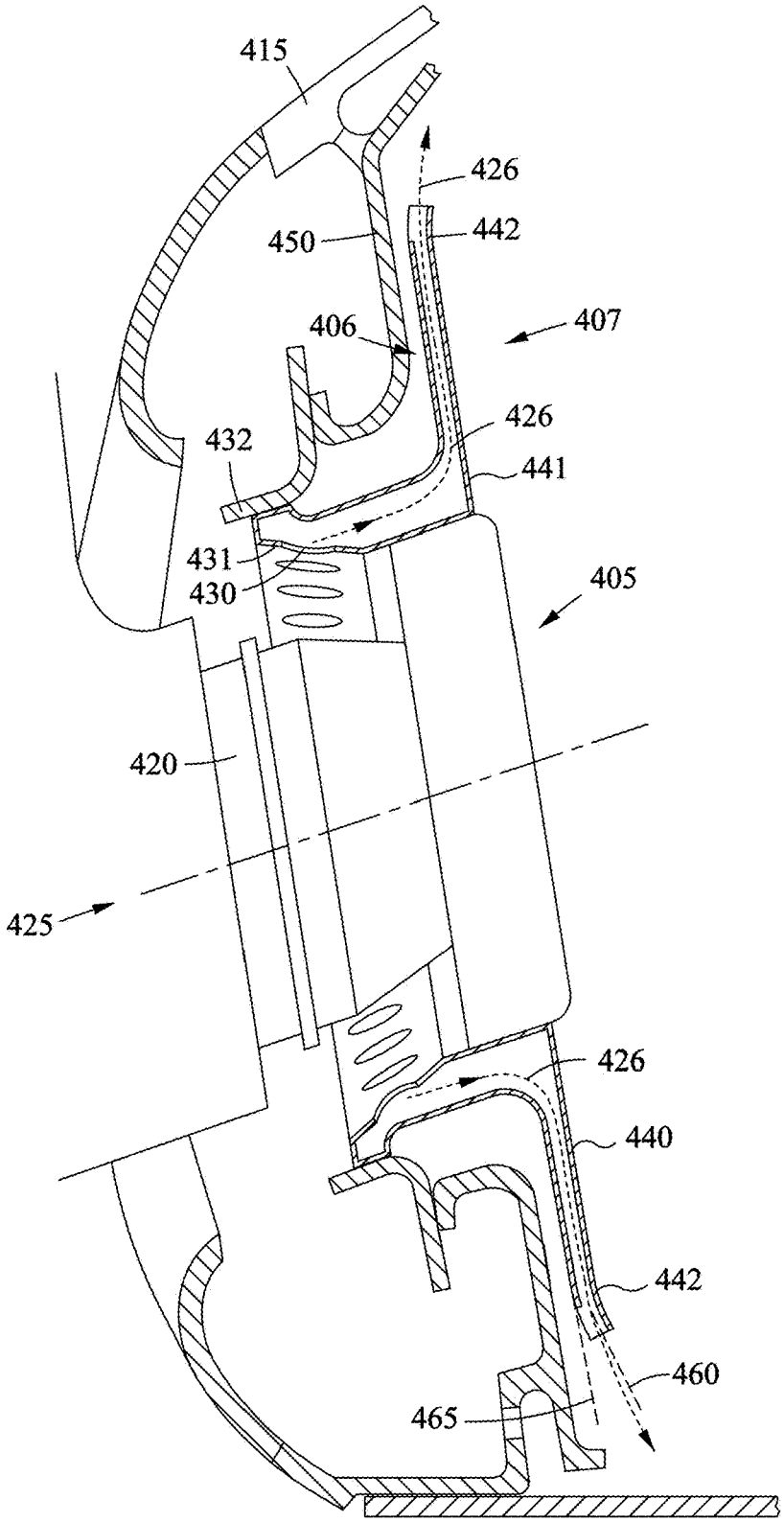
FIG. 4 depicts a cross-sectional representation of a nozzle guide according to one or more embodiments.

Annular structure 130 is configured to receive fuel nozzle 120. Annular structure 130 has an inner surface 131 and outer surface 132. Inner surface 131 and outer surface 132 span the entire length of annular structure 130 where inner surface 131 and outer surface 132 connect to guide plate seam 141 within the combustion chamber 170. Annular structure 130 is configured to receive air flow 125 for combustor shell 115. Inner surface 131 includes a plurality of cooling holes 135. Exemplary guide paths are shown in FIGS. 2 and 4.

Guide plate 140 of nozzle guide 105 includes guide plate seam 141, distal end 142, and a plurality of openings 145 on outer periphery of guide plate 140. Guide plate seam 141 is the engagement point between the guide plate 140 and the annular structure 130. Guide plate seam 141 can be at least a bend point of a single manufactured structure or a welded point between annular structure 130 and guide plate 140. In one embodiment, a portion of guide plate 140 engages with the combustor shell 115 to contact combustor shell bulkhead (e.g., bulkhead 250 of FIG. 2).

Openings 145 on outer periphery of the guide plate 140 provide air flow around the guide plate 140. Openings 145 can be at least circular or wavelike deformations (e.g., wavelike deformations 370 in FIG. 3B) on a surface of the guide plate 140. Openings 145 provide radial air flow 125 to cool the surface of guide plate 140 and provide increased air flow 125 into the combustor chamber 170. According to one embodiment, openings 145 may be positioned on guide plate 140 near an outer periphery, such as distal end 142. Openings 145 can provide radial air flow to cool the surface of guide plate 140, such as the bulkhead side and hot side of the guide plate.

Figure 2:
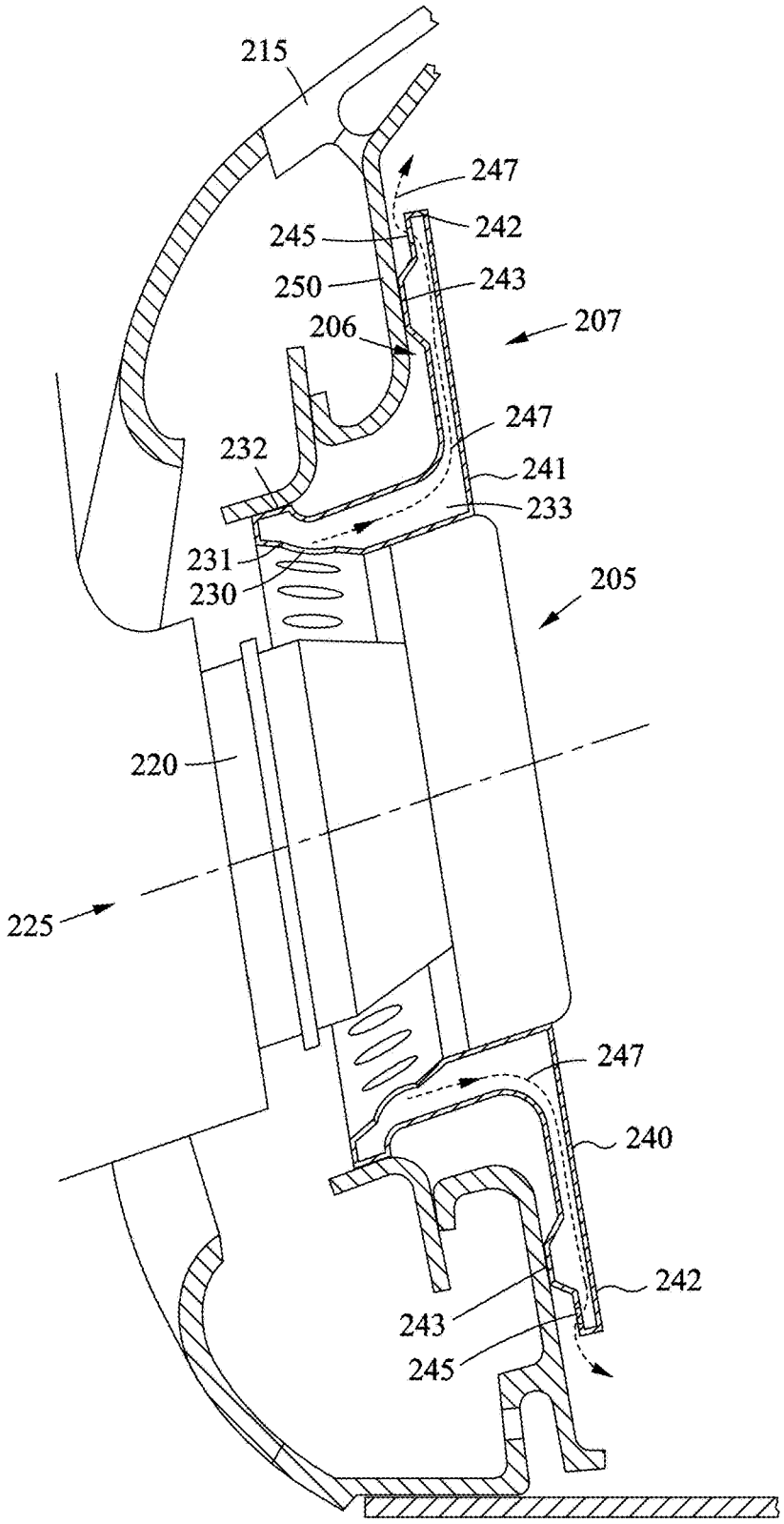
FIG. 2 depicts a cross-sectional representation of a nozzle guide according to one or more embodiments.

Referring now to FIG. 2, a cross-sectional representation is depicted of a nozzle guide 205 according to one or more embodiments. Nozzle guide 205 may relate to a configuration of the nozzle guide 105 of FIG. 1 according to one or more embodiments. Nozzle guide 205 includes annular structure 230, guide plate 240, and cooling passages 247. Nozzle guide 205 is configured to be mounted to combustor shell bulkhead 250 of shell 215 and extend into the combustor shell 215. Annular structure 230 is configured to receive fuel nozzle 220. Annular structure 230 has an inner surface 231 and outer surface 232 which may form one or more cavities shown as 233. Inner surface 231 of annular structure 230 can secure fuel nozzle 220 by a least a one of threaded connector, welding, or a combination of threading and welding.

Guide plate 240 of nozzle guide 205 includes guide plate seam 241, distal end 242, and a plurality of openings 245 on an outer periphery of guide plate 240. Guide plate seam 241 may be the interface between the guide plate 240 and the annular structure 230. Guide plate seam 241 can be at least a bend point of a single manufactured structure or a welded point between annular structure 230 and guide plate 240. Guide plate 240 engages with the combustor shell 215 to contact combustor shell bulkhead 250. For the purpose of describing features of nozzle guide 205, guide plate 240 may include a bulkhead side 206 and a heat side 207.

Distal end 242 is the outer most periphery of guide plate 240. A portion of guide plate 240 near the outer periphery of guide plate 240 and distal end 242 is shown as engagement point/surface 243 for the guide plate 240 and combustor shell bulkhead 250 of combustor shell 215. According to one embodiment, the thickness of guide plate 240 is increased in the area of engagement point/surface 243 (e.g., relative to the thickness of the other portions of the guide plate) for mounting to the combustor shell 215. In one embodiment, the engagement area and/or an outer periphery near the distal end 242 of the guide plate 240 is angled and/or includes features that protrude towards a combustor shell bulkhead 250 to form engagement point/surface 243. According to one embodiment, engagement point/surface 243 may be on a bulkhead side 205 of guide plate 240. Engagement point/surface 243 may be in contact or flush with combustor shell bulkhead 250. Thickness of engagement point/surface 243 and positive contact with shell 215 improves structural integrity and decreases distress of guide plate 240 of the nozzle guide 205.

Openings 245 on outer periphery of the guide plate 240 provide air flow 225 around the guide plate 240. Openings 245 provides radial air flow 225 to cool the guide plate 240 surface and provides increased air flow 225 into a combustor chamber (e.g., combustion chamber 170). Openings 245 can be at least circular or wavelike deformations (shown as 370 in FIG. 3B) on a surface of the guide plate 240. According to one embodiment, openings 245 may be on a bulkhead side 205 of guide plate 240.

According to one embodiment, nozzle guide 205 includes a plurality of cooling passages 247 formed between cooling holes 230 and openings 245. Cooling passages 247 may be within the inner surface 231 and outer surface 232 to allow air flow 225 to travel through the plurality of cooling holes 230 into the annular structure 230 and finally through a plurality of openings 245. Air flow provided by cooling passages 247 maintains a constant cooling air flow to guide plate 240 of the nozzle guide 205 to decrease distress. In one embodiment, cooling passages 247 are a plurality of cooling passages, wherein each passage is associated with a particular cooling hole and particular opening. In certain embodiments, cooling passages may be formed by a plenum within inner surface 231 and outer surface 232 and within the guide plate. Cooling passages 247 can provide direct air flow in and around the heat side 207 of guide plate 240 to prevent loss of protective thermal barrier coating to the nozzle guide 205 in the hot gas environment of a combustor shell. As a result, cooling flow provided by cooling passages 247 of the nozzle guide 205 can prevent deformation of the guide plate due to excessive heat.

Figure 3A:
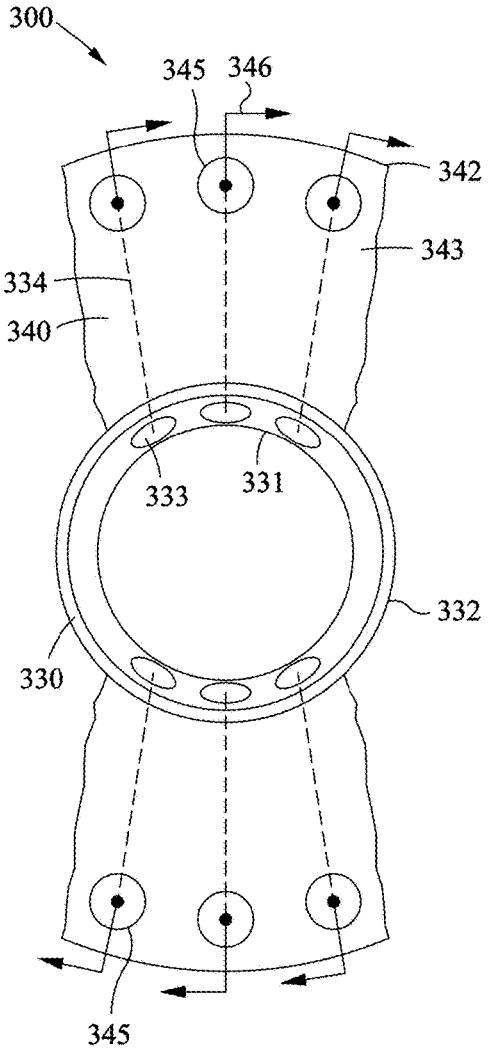
FIG. 3A depicts a graphical representation of a nozzle guide according to one or more embodiments.
Figure 3B:
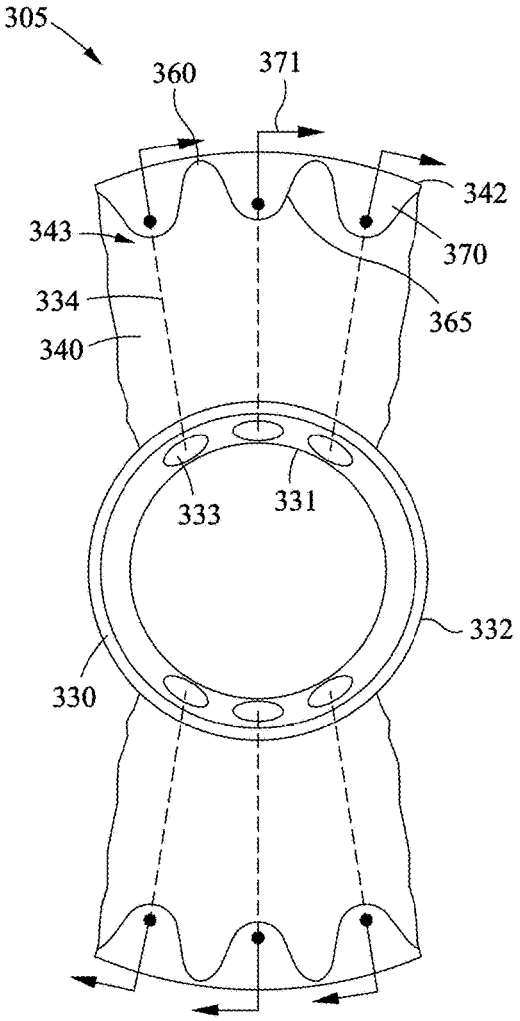
FIG. 3B depicts a graphical representation of a nozzle guide according to one or more other embodiments.

FIGS. 3A-3B depict configurations for a nozzle guide according to one or more embodiments. The bulkhead side (e.g., bulkhead side 206, attachment side) of a nozzle guide is depicted in FIGS. 3A-3B. FIG. 3A depicts a graphical representation of a nozzle guide 205 that is a partial representation according to one or more embodiments. According to one embodiment, nozzle guide 305 includes annular structure 330 with an inner 331 and outer 332 surfaces, guide plate 340, and cooling passages shown generally as 334. In the disclosed embodiment, guide plate 340 of nozzle guide 305 includes a plurality of openings 345 on outer periphery of guide plate 340. The distal end 342 of guide plate 340 is proximate engagement point/areas 343 between the guide plate 340 and combustor shell bulkhead. Openings 345 on outer periphery of guide plate 340 can be circular, or relate to other shapes, to allow for air flow 346 out of guide plate 340. Air flow 346 may be configured to flow towards a heat side (e.g., heat side 207) of the nozzle guide 300.

FIG. 3B depicts a graphical representation of a nozzle guide 305 according to one or more embodiments. Nozzle guide 305, similar to nozzle guide 300, includes annular structure 330 with an inner 331 and outer 332 surfaces, guide plate 340, and cooling passages 334. Nozzle guide 305 includes a plurality of openings in and round the outer periphery of guide plate 340 formed by wavelike deformations 370 on a surface (e.g., bulkhead side 206) of the guide plate 340. Wavelike deformations 370 on a surface of the guide plate 340 include crests 360 and troughs 365 to form openings to allow for air flow 371 out of guide plate 340. Crests 360 and troughs 365 can be at least uniform or a combination of sizes and shapes to allow air flow through guide plate 340. Air flow 371 may be configured to flow towards a heat side (e.g., heat side 207) of the nozzle guide 305.

Referring now to the figures, FIG. 4 depicts a graphical representation of a nozzle guide according to one or more embodiments. According to one embodiment, a nozzle guide 405 includes annular structure 430, and guide plate 440. Nozzle guide 405 may relate to a configuration of the nozzle guide 105 of FIG. 1 according to one or more embodiments.

Nozzle guide 405 is configured to be mounted to combustor shell bulkhead 450 of shell 415 and, at least partially, extend through opening in the combustor shell 415. Annular structure 430 is configured to receive fuel nozzle 420. Annular structure 430 has an inner surface 431 and outer surface 432. Inner surface 431 of annular structure 430 secures fuel nozzle 420 by at least a one of threaded connector, welding, or a combination of threading and welding.

Guide plate 440 of nozzle guide 405 includes guide plate seam 441, distal end 442, and a plurality of openings 445 on outer periphery of guide plate 440. For the purpose of describing features of nozzle guide 405, guide plate 440 may include a bulkhead side 406 and a heat side 407. Guide plate seam 441 can be at least a bend point of a single manufactured structure or a welded point between annular structure 430 and guide plate 440. Guide plate 440 extends radially from a base of the annular structure 430 and an outer periphery of the guide plate 440, near distal end 442 extends away from the base of the annular structure 430 toward hot side 407.

Distal end 442 is the outer most periphery of guide plate 440 and the outer periphery of guide plate 440 near distal end 442 may be curved away from the bulkhead side 406 toward hot side 407 according to one or more embodiments. As such, distal end 442 of the guide plate 440 is angled away from annular structure 430 and is offset from a straight position 465 by at least 0.015 inches 460. The angle of distal end 442 is at least enough to allow the distal end 442 of guide plate 440 to return to the straight position 465 during operation of the gas turbine engine. By way of example, temperature and pressure within a combustion chamber may deflect the distal end of guide plate 440 towards a bulkhead during operation. Accordingly, distal end 442 of guide plate 440 can be cast with curvature or be manufactured after with machine or manually manipulation to offset deflection of the guide plate 440 during operation. Radial thickness of distal end 442 and offset angle of at least 0.015 inches 460 can improve structural integrity and decreases distress of guide plate 440 of the nozzle guide 405 during engine operation.

Cooling passages 426 of nozzle guide 405 may be formed between cooling holes of inner surface 431 and openings of guide plate 440. Cooling passages 426 of nozzle guide 405 may be within inner surface 431 and outer surface 432 provide air flow to guide plate 440 of the nozzle guide 405 to decrease distress.

While this disclosure has been particularly shown and described with references to exemplary embodiments thereof, it will be understood by those skilled in the art that various changes in form and details may be made therein without departing from the scope of the claimed embodiments.

What is claimed is:

1. A nozzle guide for a combustor of a gas turbine engine, the nozzle guide comprising:

an annular structure having an inner surface and an outer surface, the inner surface including a plurality of cooling holes, wherein the plurality of cooling holes of the annular structure are configured to receive air flow;

a guide plate configured to engage with a combustor shell, the guide plate including a plurality of openings located proximate to an outer periphery of the guide plate, wherein the plurality of openings provide air flow to the outer periphery of the guide plate; and a plurality of cooling passages within the inner surface and the outer surface of the annular structure and within the guide plate, wherein the plurality of cooling passages are formed by a plenum within the inner surface, the outer surface and the guide plate, and the plurality of cooling passages provide air flow from the plurality of cooling holes to the plurality of openings of the guide plate.

2. The nozzle guide of claim 1, wherein the annular structure is configured to receive a fuel nozzle.

3. The nozzle guide of claim 1, wherein the guide plate engages with the combustor shell to contact a combustor shell bulkhead.

4. The nozzle guide of claim 1, wherein a distal end of the guide plate is angled towards a combustor shell bulkhead.

5. The nozzle guide of claim 1, wherein a thickness of the guide plate is increased at a location where the guide plate engages the combustor shell for mounting the nozzle guide to the combustor shell.

6. The nozzle guide of claim 1, wherein the plurality of openings are holes proximate to an engagement surface of the guide plate in adjacent to the outer periphery of the guide plate.

7. The nozzle guide of claim 1, wherein the plurality of openings are wavelike deformations in a surface of the guide plate.

8. The nozzle guide of claim 1, wherein the plurality of openings provide radial air flow to cool a guide plate surface.

9. The nozzle guide of claim 1, wherein the nozzle guide is a diffuser for the combustor shell.

10. A combustor of a gas turbine engine comprising:

a combustor shell, wherein the combustor shell is configured to receive a nozzle guide; and the nozzle guide including:

an annular structure having an inner surface and an outer surface, the inner surface including a plurality of cooling holes, wherein the plurality of cooling holes of the annular structure are configured to receive air flow;

a guide plate configured to engage with the combustor shell, the guide plate including a plurality of openings located proximate to an outer periphery of the guide plate, wherein the plurality of openings provide air flow to the outer periphery of the guide plate; and a plurality of cooling passages within the inner surface and the outer surface of the annular structure and within the guide plate wherein the plurality of cooling passages are formed by a plenum within the inner surface, the outer surface and the guide plate and provide air flow from the plurality of cooling holes to the plurality of openings of the guide plate.

11. The combustor of claim 10, wherein the annular structure is configured to receive a fuel nozzle.

12. The combustor of claim 10, wherein the guide plate engages with the combustor shell to contact a combustor shell bulkhead.

13. The combustor of claim 10, wherein a distal end of the guide plate is angled towards a combustor shell bulkhead.

14. The combustor of claim 10, wherein a thickness of a distal end of the guide plate is increased at a location where the guide plate engages the combustor shell for mounting the nozzle guide to the combustor shell.

15. The combustor of claim 10, wherein the plurality of openings are holes along a mounting surface of the guide plate adjacent to the outer periphery of the guide plate.

16. The combustor of claim 10, wherein the plurality of openings are wavelike deformations in a surface of the guide plate.

17. The combustor of claim 10, wherein the plurality of openings provide radial air flow to cool a surface of the guide plate.

18. The combustor of claim 10, wherein the nozzle guide is a diffuser for the combustor shell.

19. A nozzle guide for a combustor of a gas turbine engine, the nozzle guide comprising:

an annular structure having an inner surface and an outer surface, the inner surface including a plurality of cooling holes, wherein the plurality of cooling holes of the annular structure are configured to receive air flow;

a guide plate extending from a base of the annular structure, the guide plate including a plurality of openings located proximate to an outer periphery of the guide plate, wherein the plurality of openings provide air flow to the outer periphery of the guide plate, and wherein the outer periphery extends away from the base of the annular structure; and a plurality of cooling passages within the inner surface and the outer surface of the annular structure and within the guide plate wherein the plurality of cooling passages are formed by a plenum within the inner surface, the outer surface and the guide plate, and provide air flow from the plurality of cooling holes to the plurality of openings of the guide plate.

20. The nozzle guide of claim 19, wherein the outer periphery of the guide plate is curved to extend into a combustor shell away from the annular structure.

* * * * *